US005375359A

United States Patent [19]

Chesnut et al.

[11] Patent Number: 5,375,359

[45] Date of Patent: Dec. 27, 1994

[54] MAGAZINE FOR HOUSING 0.22 RIMFIRE CARTRIDGES INCLUDING TRUNCATED CARTRIDGES

[75] Inventors: M. Gaines Chesnut, Golden; Dennis D. Sweet, Evergreen, both of Colo.

[73] Assignee: Ram-Line, Inc., Wheatridge, Colo.

[21] Appl. No.: 68,991

[22] Filed: May 27, 1993

[51] Int. Cl.[5] ..... F41A 9/70

[52] U.S. Cl. ..... 42/50

[58] Field of Search ..... 42/18, 22, 50

[56] References Cited

U.S. PATENT DOCUMENTS

| | | | |
|---|---|---|---|
| 313,856 | 3/1885 | Diss | 42/50 |
| 4,099,595 | 3/1982 | Chesnut et al. | 42/50 |
| 4,329,802 | 5/1982 | Coonan | 42/50 |
| 4,509,283 | 4/1985 | Chesnut | 42/50 |
| 4,516,346 | 5/1985 | Farrar et al. | 42/50 |
| 4,672,760 | 6/1987 | Chesnut et al. | 42/50 |
| 4,790,094 | 12/1988 | Chesnut et al. | 42/50 |
| 4,862,620 | 9/1989 | Chesnut et al. | 42/50 |

*Primary Examiner*—Stephen C. Bentley

*Attorney, Agent, or Firm*—Sheridan, Ross & McIntosh

[57] ABSTRACT

A cartridge magazine for containing and feeding .22 rimfire cartridges including truncated, hollow point or flat nosed cartridges is disclosed. The magazine includes a metal magazine body having first and second sidewalls and first and second end walls. The cartridge storage area is defined by these four walls. The magazine body has a cross-sectional area that is substantially the same throughout the height of the magazine body. The dimensions related to the cross-sectional area are critical to proper feeding of truncated cartridges into the firearm while avoiding cartridge jamming. The magazine body includes an outlet section from which the cartridges enter the firearm from the magazine body. A number of structural members are located at the outlet section to assist in proper feeding of the cartridges.

18 Claims, 7 Drawing Sheets

MAGAZINE FOR HOUSING 0.22 RIMFIRE CARTRIDGES INCLUDING TRUNCATED CARTRIDGES

FIELD OF THE INVENTION

The present invention relates to cartridge magazines and, in particular, to a cartridge magazine for housing and properly feeding .22 rimfire cartridges, including truncated, hollow points and blunted end solid points, as well as regular shaped round nose bullets, without causing jamming of the firearm that receives the cartridges.

BACKGROUND OF THE INVENTION

Numerous cartridge magazines for use with firearms have been previously devised. The magazine configuration is typically dependent on the kind of cartridge that is being contained. Pistols and rifles for firing .22 rimfire cartridges are popular weapons among shooters. The assignee of the present invention is the owner of a number of patents directed to magazines for housing .22 rimfire cartridges. In particular, U.S. Pat. No. 4,672,760, issued Jun. 16, 1987, U.S. Pat. No. 4,790,094, issued Dec. 13, 1988, and U.S. Pat. No. 4,862,620, issued Sept. 5, 1989 describe curved magazines for housing .22 rimfire cartridges. These magazines are configured to be used with rifles. With regard to pistols for firing .22 rimfire cartridges, the assignee is also the owner of U.S. Pat. No. 4,509,283 issued Apr. 9, 1985 that discloses a cartridge magazine having a straight body for housing .22 rimfire cartridges. Another magazine for housing rimfire cartridges for use with a plastic pistol is described in U.S. Pat. No. 5,099,595 issued Mar. 31, 1992. These two magazines are preferably made of plastic. A metal body magazine for housing .22 rimfire cartridges is made by Sturm-Ruger & Co., Inc. and is identified as "Mark II ®". The .22 rimfire cartridges that are housed in the foregoing magazines can be categorized in accordance with two general groupings. A first group consists of .22 rimfire cartridges that have a rounded and substantially smooth bullet that is fired from the firearm, with the shell or casing being ejected. In a second group, the bullet is truncated and does not have a rounded tip configuration. Instead, the bullet is substantially frusto-conical in shape. Many shooters either prefer or find the truncated cartridge design advantageous, at least in certain shooting situations. The truncated bullet is marketed as having hyper-velocity, in comparison with regular, rounded nose bullets.

Because of the truncated design, it has been determined that the truncated .22 rimfire cartridges create cartridge jamming problems when fed into .22 pistols using the straight magazine body design. That is, when truncated cartridges are fed by straight body magazines, that perform as expected for rounded bullets, jamming problems occur in .22 pistols. In testing available cartridge magazines having a straight body, it was determined that these magazines create jamming problems with .22 pistols at an unacceptable level when they are feeding truncated .22 rimfire cartridges. It would therefore be beneficial to provide a magazine that properly feeds both regular and non-rounded .22 rimfire cartridges without causing cartridge jamming that can occur due to cartridges having flattened noses, shoulders and the like.

SUMMARY OF THE INVENTION

In accordance with the present invention, a cartridge magazine is provided for housing and properly feeding truncated .22 rimfire cartridges without causing jamming of the cartridges in the firearm to which the magazine is attached. The magazine body is formed with critical dimensions for maintaining an essential position of the truncated cartridge during its movement in the magazine body.

More particularly, the magazine body includes first and second sidewalls and first and second end walls that together form an integral, one-piece magazine body. A cartridge storage area is defined within these four walls of the magazine and extends substantially throughout the height of the magazine body. A cross-sectional area is also definable along this storage area and this cross-sectional area is substantially the same throughout the height of the magazine body. The dimensions of this cross-sectional area are key to providing the critical angle or limited range of angles at which the truncated cartridge is positioned in the storage area of the magazine body. This critical angle must be at least 29° . Specifically, the cross-sectional area has a length dimension that is in the range of 0.856–0.864 inch and is preferably 0.860 inch. The width of this area is in the range of 0.221–0.229 and is preferably 0.225 inch. The truncated cartridge is located within the magazine body using such length and width. If these dimensions are not met, the necessary position of the truncated cartridge is not maintained and unacceptable jamming of truncated cartridges occurs.

Movements of the cartridges within the magazine body is controlled using a follower assembly that preferably includes a constant force spring. Unwound portions of the spring are located adjacent an inner surface of the second end wall. The rim ends of the cartridges are located adjacent to the unwound portions but do not contact the spring throughout substantially all of the length of the unwound portions, due to a gap created between the unwound portions and the rim ends. The magazine body also includes a pair of ribs formed on the inner surface of each of the first and second sidewalls. Each of these four ribs extends inwardly into the storage area of the magazine for a predetermined distance to engage and guide the truncated and/or rounded .22 rimfire cartridges during their movement within the magazine body. Such ribs further contribute to the positioning and control of movement of such cartridges.

The upper portions of the first and second sidewalls of the magazine body each have a jog portion. Each jog portion is located relatively more adjacent an outlet opening of the magazine from which single file cartridges exit the magazine and enter the firearm. Each jog portion includes an inward jog member and an outward jog member. The inward jog member extends inwardly towards the cartridges and each inward jog member contacts the cartridge during its movement in the magazine. The outward jog member does not contact the cartridge during its entry into the firearm. The distance or spacing between the two outward jog members is greater than a corresponding spacing between the two inward jog members. Located adjacent to the inward jog members are first and second slots formed in each of the first and second sidewalls. Each of these two slots is defined by a pair of legs, with a first leg of each slot being disposed at an angle relative to a center axis passing through the height of the magazine body. This offset angle contributes to maintaining the truncated cartridge in its desired nose-up position ensuring its proper entry into the firearm.

The second end wall also has a pair of curved entry edges located at the upper portions of the magazine body. These edges act as a smooth lead-in of the magazine into the firearm well so that the magazine is readily inserted into the well without catching thereon.

Based on the foregoing summary, a number of important objectives of the present invention are immediately recognized. A cartridge magazine is provided that properly feeds all .22 rimfire cartridges into a firearm including truncated cartridges without causing the .22 firearm to jam. This magazine is characterized by critical dimensions that position the cartridges, particularly truncated cartridges, at a predetermined angle during their movement in the cartridge magazine. A constant force spring is used to move the cartridges and unwound portions thereof are desirably spaced from the cartridge rim ends. Unwanted catching of the magazine on the firearm well is avoided by using curved entry edges at the upper part of the magazine. The magazine body also has a number of other structural characteristics that contribute to strict control of truncated cartridges to avoid cartridge jamming. These include mechanical configurations or designs found at the upper or outlet section of the magazine body.

Additional advantages of the present invention will become readily apparent from the following discussion, particularly when taken together with the accompanying drawings.

DETAILED DESCRIPTION

Figure 1:
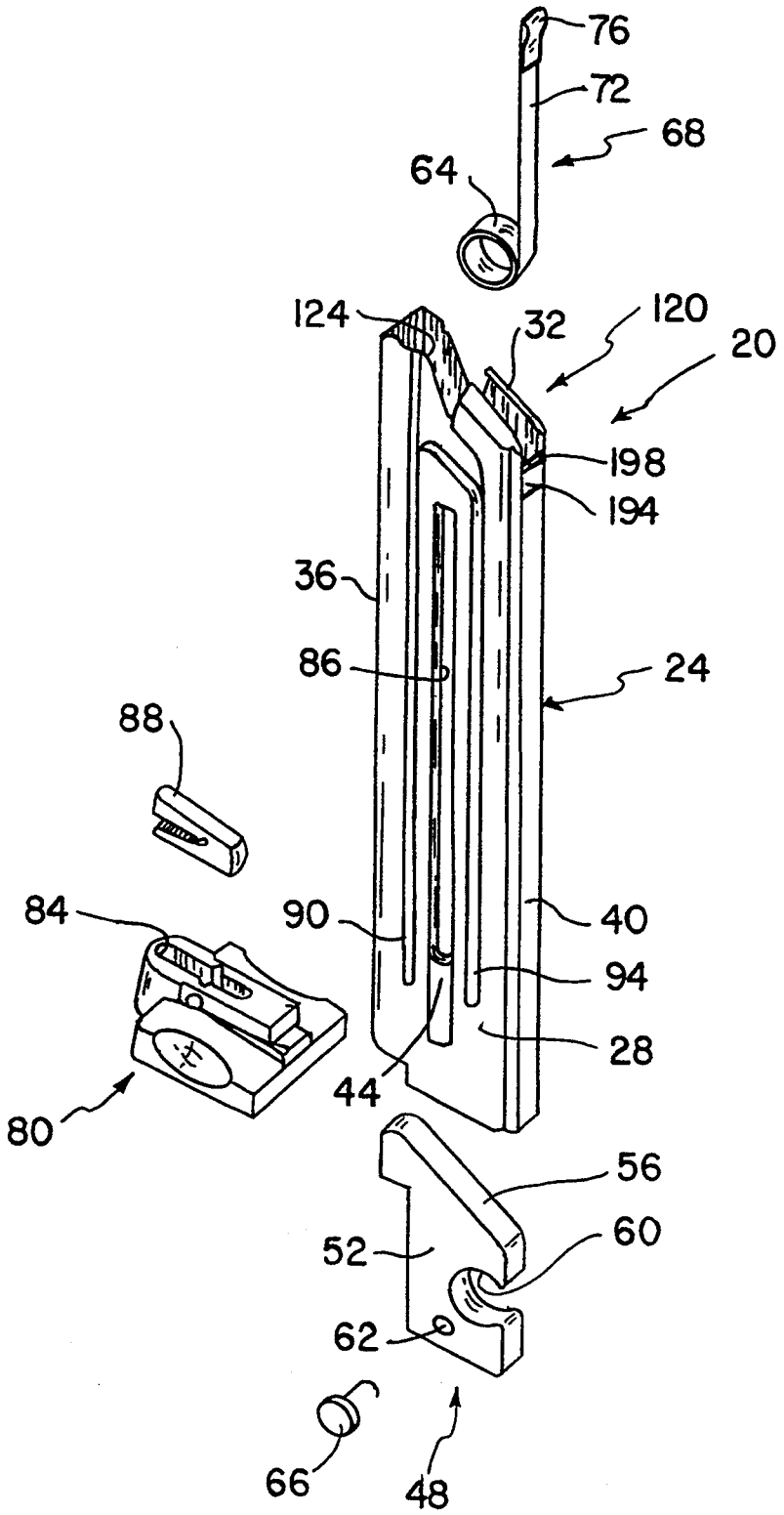
FIG. 1 is an exploded view of the cartridge magazine of the present invention.

A cartridge magazine 20 is described for housing and supplying .22 rimfire cartridges including truncated cartridges to a .22 firearm, such as a pistol. With reference to FIG. 1, the magazine 20 includes a magazine body 24, preferably made of metal and having a number of walls, namely: first sidewall 28, second sidewall 32, first end wall 36 and second end wall 40. The magazine body 24 is an integral, one-piece member in which the first and second end walls 36, 40 interconnect the first and second sidewalls 28, 32. The four walls define or surround a cartridge storage area 44 that is able to house or contain a number of .22 rimfire cartridges including truncated cartridges.

Figure 2:
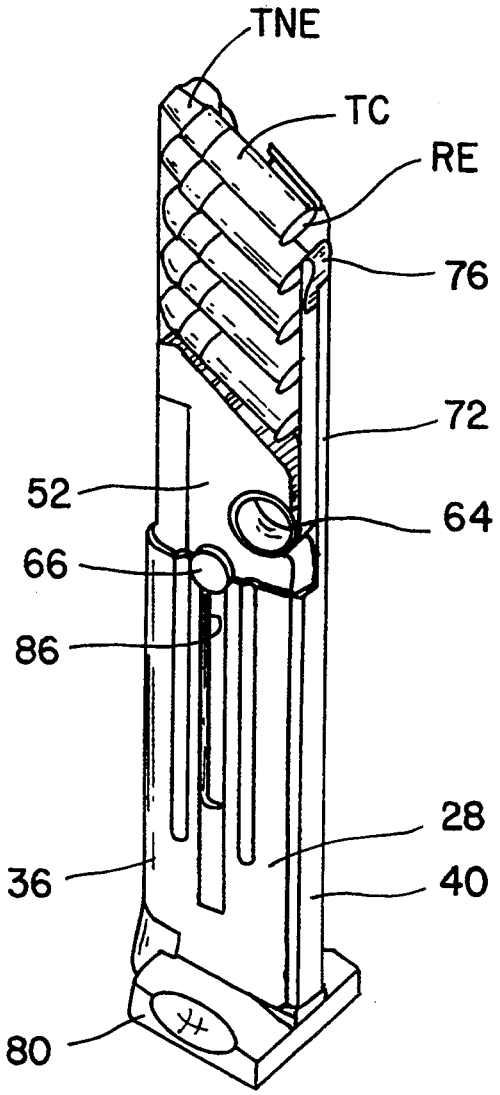
FIG. 2 is a perspective view of the cartridge magazine with a portion of the first sidewall cut away to illustrate the follower and arrangement of truncated cartridges in the magazine.

The cartridge magazine 20 includes a follower 48 having a body 52 with a support surface 56. An opening 60 is formed in the follower body 52 adjacent an edge thereof. The follower opening 60 is used to receive a wound portion 64 of a constant force (conforce) spring 68. The conforce spring 68 is used in imparting upward movement of the follower 48. A cartridge resides on, or is in direct contact with, the upper surface 56 of the follower body 52 and other cartridges are located above this cartridge and are caused to move using the conforce spring 68. The spring 68 also has an unwound portion 72 having free end portions 76 that are used in maintaining a fixed position of these portions of the conforce spring 68. With reference to FIG. 2, the position of the wound portion 64 in the follower opening 60 is illustrated. As can be understood, as additional cartridges are positioned in the magazine body 24, the length of the unwound spring portion 72 increases as the follower body 52 moves downwardly within the magazine body 24 since the free end spring portion 76 remains fixed in position. As each cartridge is removed from the cartridge magazine 20, the conforce spring 68 causes the follower 48 and the cartridges to move upwardly so that the next cartridge is in position to exit the magazine 20. The follower 48 also includes a hole 62 for receiving a follower pin 66. The follower pin 66 is engagable by the shooter in connection with controlling the position of the follower 48 within the storage area 44 during loading of cartridges into the magazine 20. The follower pin 66 is positioned through a channel 86 formed substantially throughout the height of the first sidewall 28. The follower pin 66 is primarily for the purpose of engaging the firearm bolt hold open mechanism when the follower 48 is positioned so that the last cartridge can be received by the firearm. Returning to FIG. 1, the magazine 20 also includes a base plate 80 that is connected to the lower end of the magazine body 24. The base plate 80 includes a cavity 84 for receiving a base plate lock 88, which is inserted into the cavity 84 for use in holding the base plate 80 to the magazine body 24.

Figure 3:
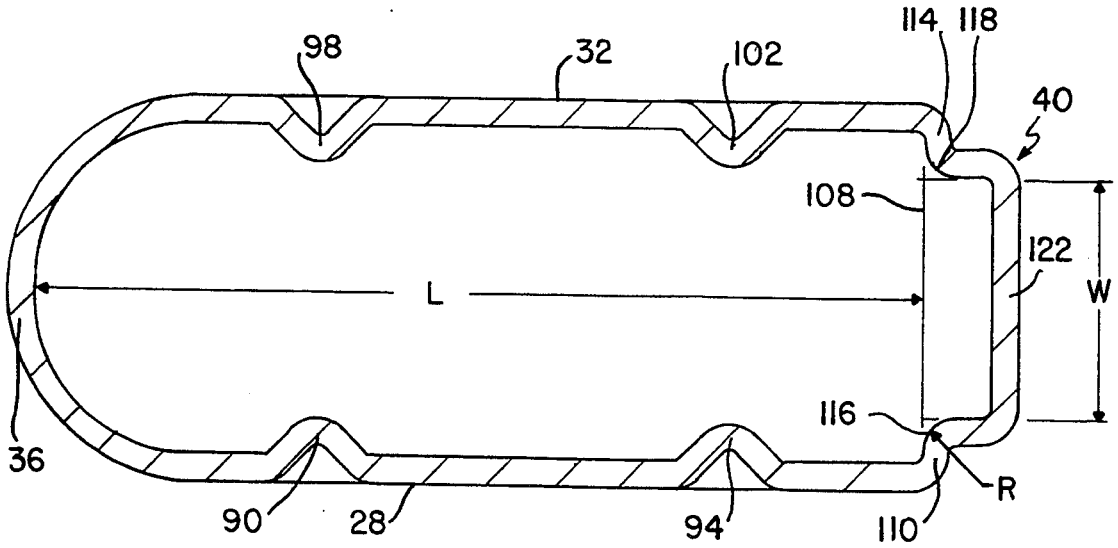
FIG. 3 is a cross-sectional view of the magazine body taken along substantially any portion of the height of the magazine body.

Referring to FIG. 3, as well as FIGS. 1–2, each of the sidewalls 28, 32 has ribs for controlling the position of cartridges during their movement in the storage area which will be explained later herein. As seen in FIG. 3, the first sidewall has a pair of ribs 90, 94 that extend inwardly into the storage area 44. Similarly, the second sidewall has a pair of inwardly extending first and second ribs 98, 102, respectively. All of the ribs extend a sufficient distance into the storage area 44 in order to contact the cartridges contained therein. This contact is substantially only along each cartridge case and not at the rim or nose ends of the cartridge. The contact is sufficient to influence or assist in the desired positioning of the cartridges within the storage area 44.

A key aspect of the present invention relates to the dimensions of the cross-sectional area found along the height of the magazine body 24 and particularly in the storage area 44. As further seen in FIG. 3, the second end wall 40 has a pair of curved inward members 110, 114 that are integrally connected to the first and second sidewalls 28, 32, respectively. Preferably, each of these curved members 110, 114 has a radius of 0.031 inch±0.002 inch. This structure and dimensions cause the rim ends (RE) of the truncated .22 rimfire cartridges to contact the second end wall 40 at two positions only, i.e., at the inward members, 110, 114. The truncated nose ends (TNE) of the truncated .22 rimfire cartridges contact the first end wall 36 along substantially only one position (line to point contact).

Figure 4:
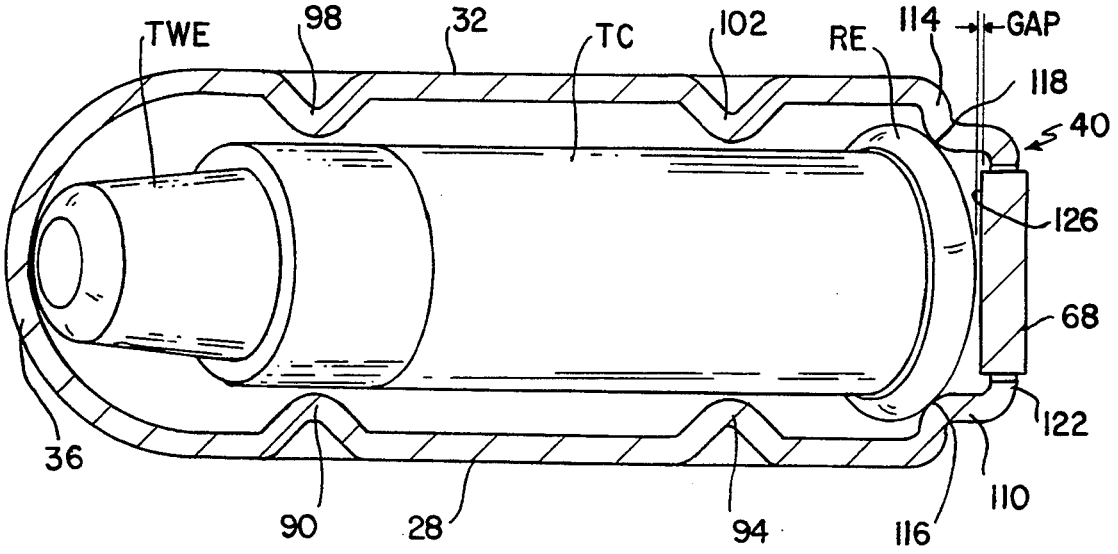
FIG. 4 is a cross-sectional view illustrating a truncated .22 rimfire cartridge contained in the magazine of the present invention and having the preferred length dimension of 0.860 inch and the preferred width dimension of 0.225 inch and also illustrating the gap between the cartridge rim end and the constant force spring.
Figure 5:
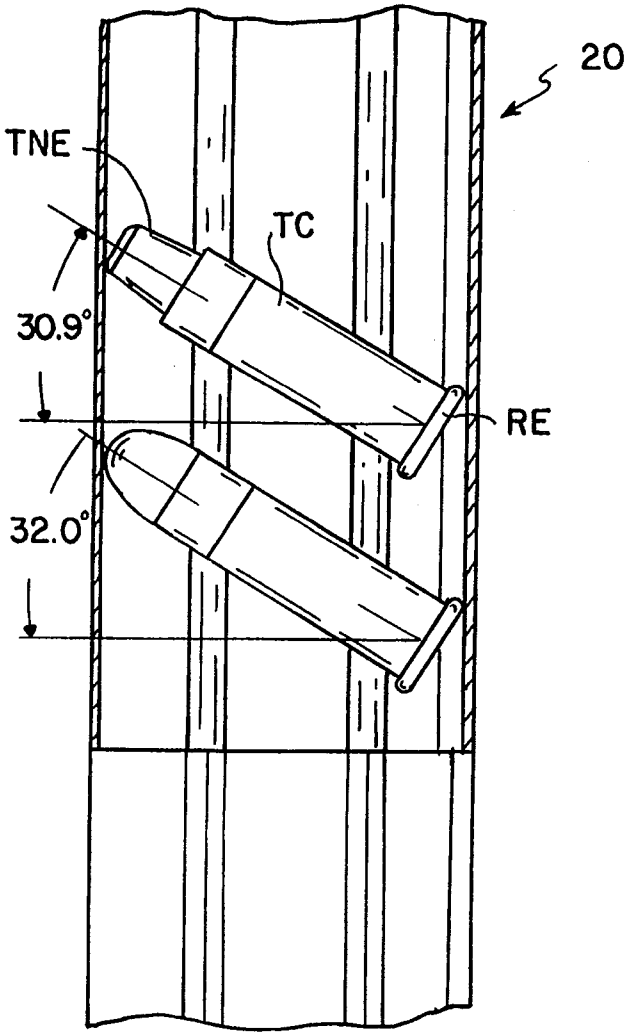
FIG. 5 is an enlarged view of a truncated .22 rimfire cartridge illustrating the preferred angle of the cartridge contained in the magazine of the present invention.

Critical to proper operation of the magazine 20 is the angle at which each of the .22 rimfire cartridges are maintained in the cartridge storage area 44. Proper operation involves feeding of .22 rimfire cartridges from the magazine 20 into the firearm to which it is connected without cartridge jamming. It has been determined that acceptable operation without jamming occurs when the .22 rimfire cartridges are disposed in the storage area 44 within a critical range of angles. When cartridges are maintained within this critical range, .22 rimfire cartridges, including truncated, blunt, flat nose and/or hollow point cartridges, effectively exit the magazine 20 into the firearm without jamming. Hollow point bullets have essentially a truncated effect since their rounded noses are cut off by the hollowing of the nose as well as shortening the total length. With reference to FIGS. 4 and 5, as well as FIG. 3, truncated .22 rimfire cartridges are illustrated. As can be seen, the nose ends (TNE) of these cartridges are truncated and have a generally frusto-conical shape, in contrast to .22 rimfire cartridges that have a spherically shaped or rounded and smooth nose end. The truncated cartridges are also usually shorter in length than rounded .22 rimfire cartridges. Currently available truncated cartridges have a length in the range of about 0.955–0.967 inch, while rounded nose cartridges have a length above 0.980 inch. Thus, the angle at which each truncated cartridge is positioned in the storage area 44 is different from that of rounded .22 rimfire cartridges.

With regard to the critical range of angles, the angle of a cartridge in the storage area 44 is defined using the center axis through the cartridge and a straight line extending from the center axis, at the second end wall directly across to the first end wall 36, as illustrated in FIG. 5. If the cartridges, including the truncated cartridges, are not maintained within the critical range of angles, either an unwanted "nose-up" or "nose-down" condition results. That is, the nose end of the cartridge is not located in the necessary position so that each cartridge can be properly fed into the firearm without jamming.

In order to provide cartridge positioning in the storage area 44 within the critical range of angles, critical dimensions must be maintained along the height of the magazine body 24. As further seen in FIG. 3, this cross-sectional area is definable using a length (L) dimension and a width (W) dimension. The values of L and W are critical in controlling the nose angles of the cartridges, especially the truncated cartridges, to avoid cartridge jamming. The length dimension extends from an apex of the inner surface of the rounded first end wall 36 to an imaginary line 108 that extends between center points 116, 118 of the curved inward members 110, 114, respectively. The center points 116, 118 are located on the inner surfaces of the inward members 110, 114. The width dimension is the distance between the beginning of each curve or arc of the curved inward members 110, 114, which are adjacent to the straight section 122 of the second end wall 40. When the length dimension is varied, the critical angle is changed. For example, if the length dimension is increased, the angle at which the cartridge is positioned in the storage area 44 decreases and, with sufficient increase in the length (L) dimension, the resulting angle is outside of the critical range and an unwanted "nose-down" condition occurs. Similarly, if the critical angle increases out of the required range by decreasing the length dimension, an unwanted "nose-up" condition occurs that causes or contributes to unwanted cartridge jamming. With regard to the width dimension, an increase of the width, for example, outside of the critical range, results in the rim ends of the cartridges contacting the inner surface of the second end wall 40, instead of the curved inward members 110, 114. This will result in a decreased cartridge angle that is outside of the critical range.

In connection with the critical angles to be maintained by the truncated cartridges within the storage area 44, such an angle is at least 29° and falls within the range of 29°–33°, with a preferred angle of 30.9°. The length dimension (L) is within the range of 0.856–0.864 inch and preferably 0.860 inch and the width dimension (W) is in the range of 0.221–0.229 inch and preferably 0.225 inch.

As also seen in FIG. 4, a gap or space 126 is created between the rim end RE of the cartridge and the spring 68 that extends along the second end wall 40. The gap 126 is present substantially along all of the second end wall. 40 when the cartridges are contained in the magazine. The dimensional control of the cartridge in accordance with the cartridge contact points along or at first end wall 36, together with points at 116, 118 yields the necessary cartridge angle as well as providing an area for receiving the conforce spring 68.

Figure 6:
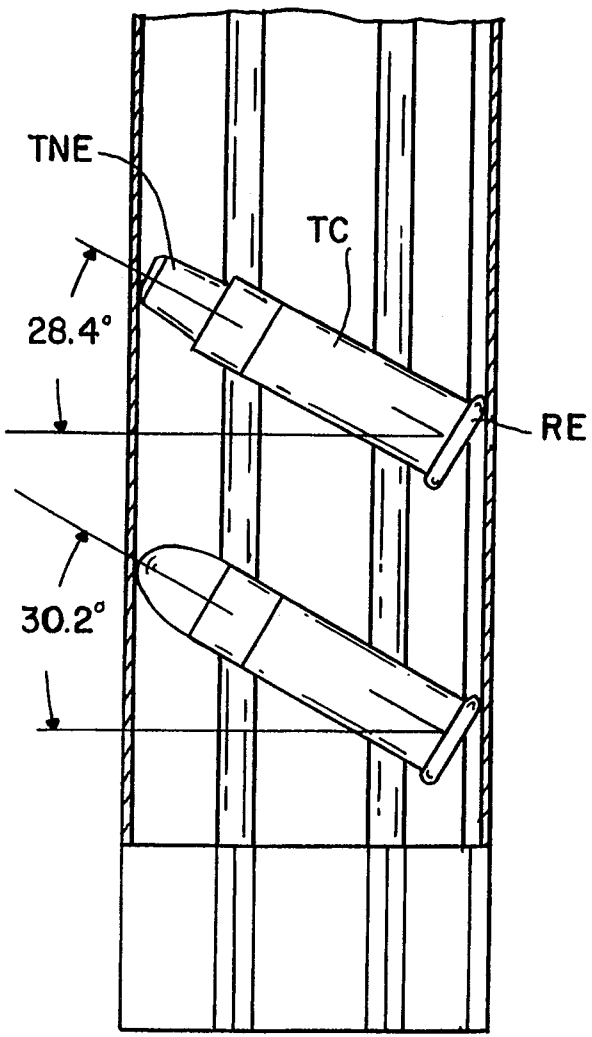
FIG. 6 is an enlarged view of a truncated .22 rimfire cartridge located at an angle in a cartridge magazine that would result in unacceptable jamming problems.
Figure 7:
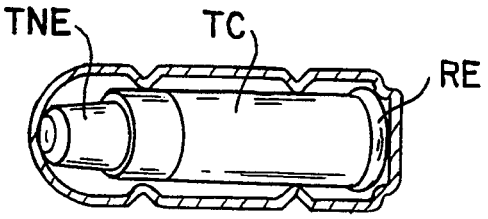
FIG. 7 is a cross-sectional view of the cartridge of FIG. 6 having a length dimension of 0.890 inch and a width dimension of 0.225 inch.

With reference to FIGS. 6–7, a magazine is illustrated for housing .22 rimfire cartridges, including truncated cartridges, that has an unacceptable cross-sectional area for truncated cartridges. The length dimension, i.e., 0.890 inch, associated with the cross-sectional area in the storage area of this magazine is significantly greater than the acceptable length dimension of the cartridge magazine 20. The angle at which each truncated cartridge is positioned in this magazine is about 28.4°, which is less than the lower angle of 29° of the above-noted range of angles. Because of this, when truncated .22 rimfire cartridges are fed into a .22 firearm using such a magazine, unacceptable cartridge jamming occurs. It is also noted that rim of the cartridge in FIG. 7 contacts the second end wall, unlike the gap 126 that is illustrated in FIG. 4.

With reference to FIGS. 8–12, further structural features of the magazine body 24 are next described related to an outlet section 120. The outlet section 120 controls the upper cartridge in the magazine to prevent it from diving, twisting or flipping to ensure proper direction of the cartridge toward the firearm barrel during chambering. The geometric design responds to dynamic changes as a result of cartridge rapid acceleration forces during short velocity bursts and directional change. The outlet section 120 is located at the upper end of the magazine body 24 and includes an outlet opening 124 from which each .22 rimfire cartridge, including truncated cartridge, leaves the magazine. More specifically, the truncated nose end (TNE) of the truncated cartridge (TC) is caused to move through the outlet opening 124. The outlet section 120 includes a pair of lips 128, 132 that engage the cartridge rim end and prevent the cartridge from moving further in a direction upwardly from the magazine body 24. At this time, the upper cartridge is waiting for the bolt face of the firearm to engage the rim end of the upper cartridge in order to initiate its forward movement. This initial forward movement results in a cartridge nose down rotation attempt. This occurs because a negative torque is generated due to the force being applied by the bolt face at the rim end circumference and not the center of the circularly shaped rim end. This unwanted rotation is prevented by reactions to engagement of cartridges below the upper cartridge but mostly by tipping in to and engaging of the nose at the first end wall 36 near outlet opening 124. The lips 128, 132 also contact and hold the follower 48 in the magazine body 24 when no cartridges are contained in the magazine 20.

At the end of the outlet section 120 opposite from the lips 128, 132 is a pair of jog portions 136, 138. The first jog portion 136 is an extension of the first sidewall 28 and the second jog portion 138 is an extension of the second sidewall 32. Each of the two jog portions includes an inward jog member and an outward jog member. The first jog portion 136 has an inward jog member 142 and an outward jog member 146. The inward jog member 142 has an inner surface that contacts or engages the uppermost cartridge and continues to contact the cartridge during its controlled removal from the magazine 20 into the firearm chamber through the outlet opening 124. The outward jog member 146 does not contact the cartridge and is integrally joined to the inward jog member 142 at an abrupt junction 148. Similarly, the second jog portion 138 includes an inward jog member 150 and an outward jog member 154. The inward jog member 150 also engages and contacts the cartridge and continues to engage it during the desired or controlled movement of the cartridge from the magazine 20 into the firearm chamber. The outward jog member 154 does not contact the cartridge and is integrally joined to the inward jog member 150 at the abrupt junction 158. The jog portions 136, 138 act to position and properly guide the truncated cartridge (TC) so that it moves into the firearm without jamming. In particular, the tightness provided by the inward jog members 142, 150 prevents a cartridge nose down condition by eliminating loose geometric tolerances. This tightness contributes to preventing lateral rotation, which would effectively permit cartridges to twist on each other and come out of vertical alignment. As the upper cartridge moves forward, inward jog members 142, 150 continue lateral guiding, and prevent upward "flipping," of the cartridge to the chamber and the lips 128, 132 remain in engagement with the rim end. The beginning of the outlet opening 124 becomes critical. If the beginning thereof is too low, the nose end of the cartridge is unable to appropriately engage the first end wall 36 at this location and the desired engagement would be lost for this upper cartridge. If the location of the beginning of the outlet opening 124 is too high, there is premature engagement with the nose end and this prevents the proper exiting of the upper cartridge before chambering.

Intermediate the lips 128, 132 and the jog portions 136, 138 are a pair of slots 170, 174. The first slot 170 is formed in the outlet section 120 extending from the first sidewall 28. The second slot 174 is formed in the outlet section 120 extending from the second sidewall 32. Each of the two slots 170, 174 is defined as including first and second legs. The first slot 170 has a first leg 178 adjacent to the first lip 128 and a second leg 182 adjacent to the inward jog member 142 of the first jog portion 136. The second leg 182 defines an acute angle with respect to a center axis through the center of the height of the magazine body 24. That is, the second leg 182 is offset from by sloping forwardly from, and is not parallel to, such a center axis. Likewise, the second slot 174 has a first leg 186 adjacent to the second lip 132 and a second leg 190 adjacent to the inward jog member 150, with the second leg also being at an acute angle relative to a center axis through the second sidewall 32 of the magazine body 24. These externally formed angles, which are the result of the configurations of the second legs 182, 190, also assist and contribute to guiding the rimfire cartridges including truncated cartridge into the firearm without jamming by engaging the rim of the cartridge.

When the rim end of the upper cartridges passes the first and second slots 170, 174, upward forces cause the rear of the cartridge to rotate vertically upward so that the bolt face is fully engaged and the rear of the rim end is fully seated, held by the bolt extractor of the firearm. This normal action is sometimes slower, partially due to variances in powder loading and different cartridges, dimensional anomalies and bullet shape, and random geometrical stackups due to geometric tolerances throughout the gun and magazine. When this impedance occurs, the rims sometimes do not "snap up" and rise vertically without encountering resistance. Second legs 182, 190 act to partially engage the rim circumference of the upper cartridge as the bolt slides forward, thus imparting further upward force assistance to the cartridge rear end. These surfaces must not be parallel to the magazine center line to maintain an upward angle for engagement of the rim end. The angles formed by the first legs 178, 186 are substantially parallel to magazine center line so that a clean, unimpeded vertical "escape" of the rim is achieved.

Figure 8:
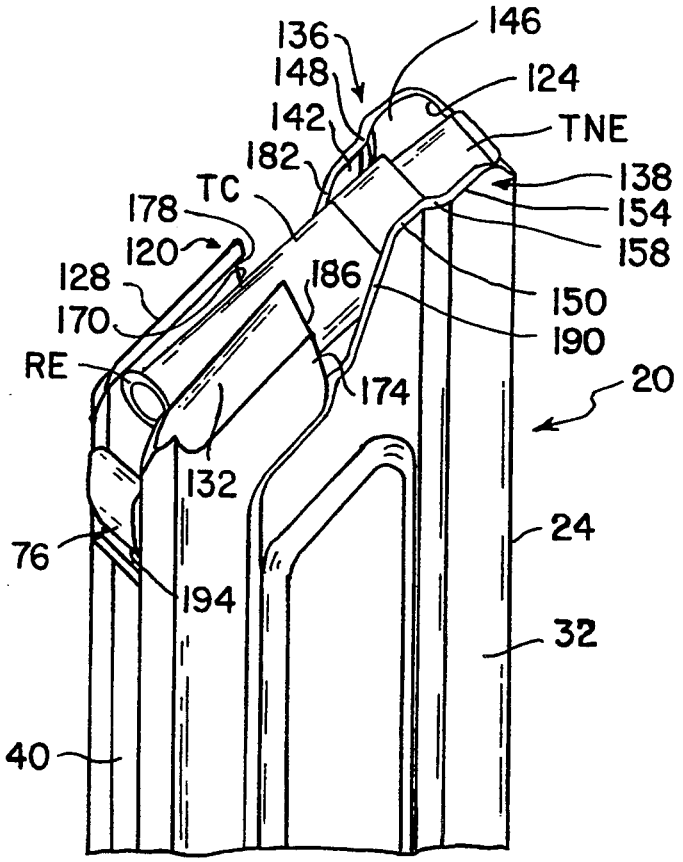
FIG. 8 is an enlarged, fragmentary, perspective view of the magazine illustrating in greater detail the parts of the outlet section of the magazine.
Figure 9:
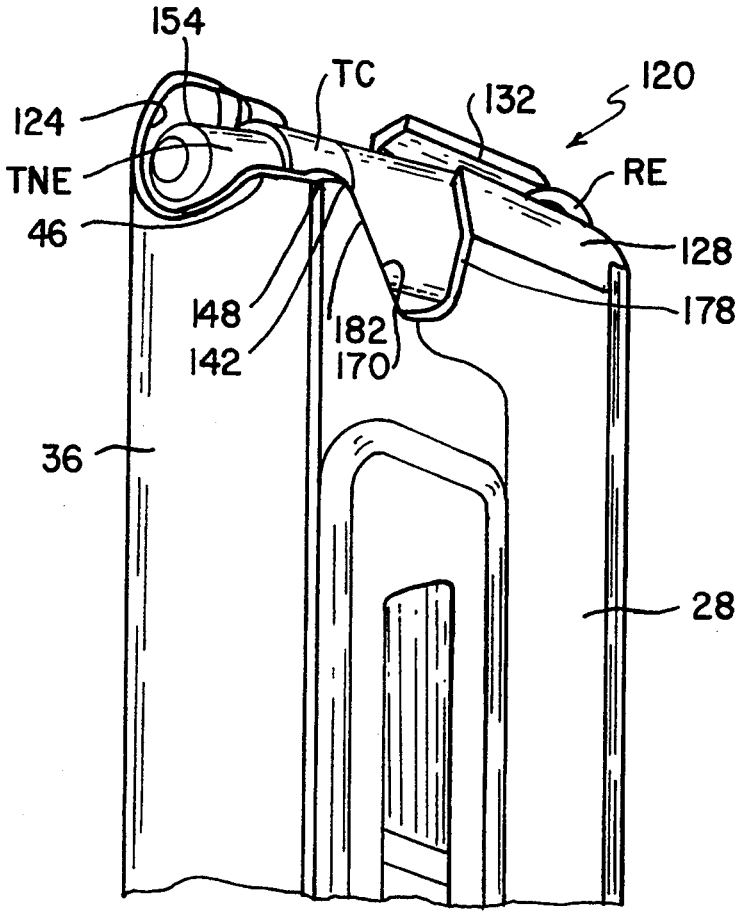
FIG. 9 is an enlarged, fragmentary, perspective view of the magazine from a side opposite that of FIG. 8 showing in greater detail the parts of the outlet section of the magazine.
Figure 10:
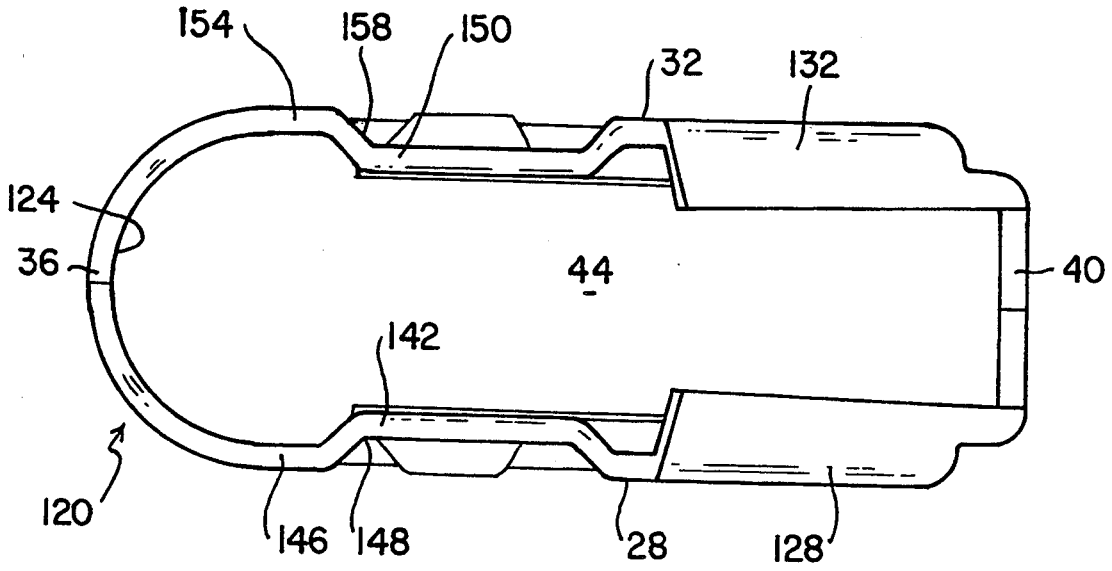
FIG. 10 is a top plan view of the cartridge magazine illustrating the outlet section thereof.
Figure 12:
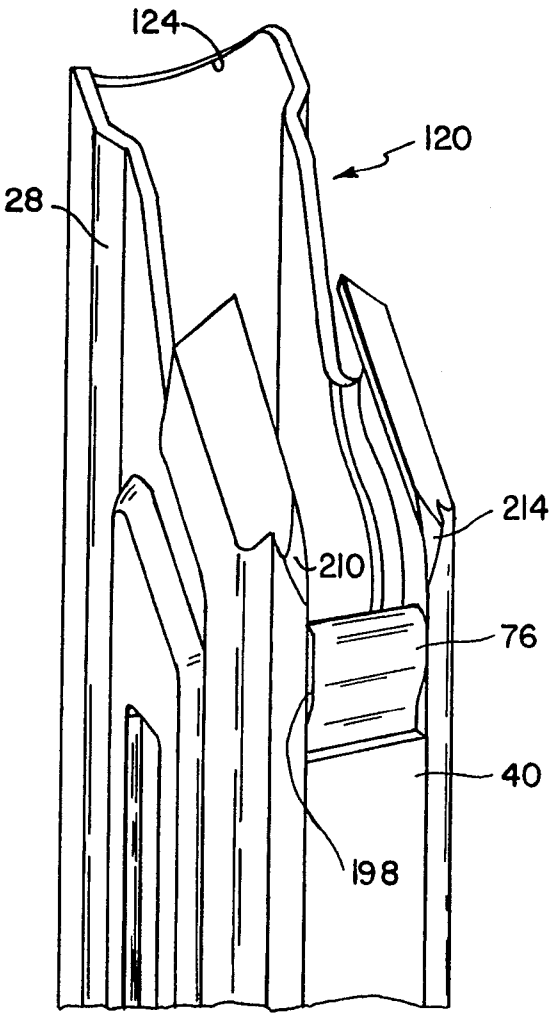
FIG. 12 is an enlarged, fragmentary, perspective view illustrating the curved entry edges.

As also seen in FIG. 8, the first end wall 40 includes a generally rectangular hole or slot 194 formed through the second end wall 40. The free end portions 76 of the conforce spring 68 exit the storage area 44 of the magazine body 24 adjacent to an inner surface of the second end wall 40 and are received back into the inner surface of the second end wall 40 through the hole 194. In re-entering the magazine body 24 through the hole 194, the free end spring portions 76 cross over a bridge piece 198 (FIG. 12). The free end spring portions 76 re-enter the rectangular hole 194. The bridge piece 198 acts as a pin, over which the free end spring portions are connected to the second end wall 40. As previously noted, this connection enables the conforce spring 68 to be wound and unwound during unloading and loading of cartridges, respectively. In one embodiment, the bridge piece 198 is deflected or located inwardly a slight amount to provide a space for free end spring portions 76.

Figure 11:
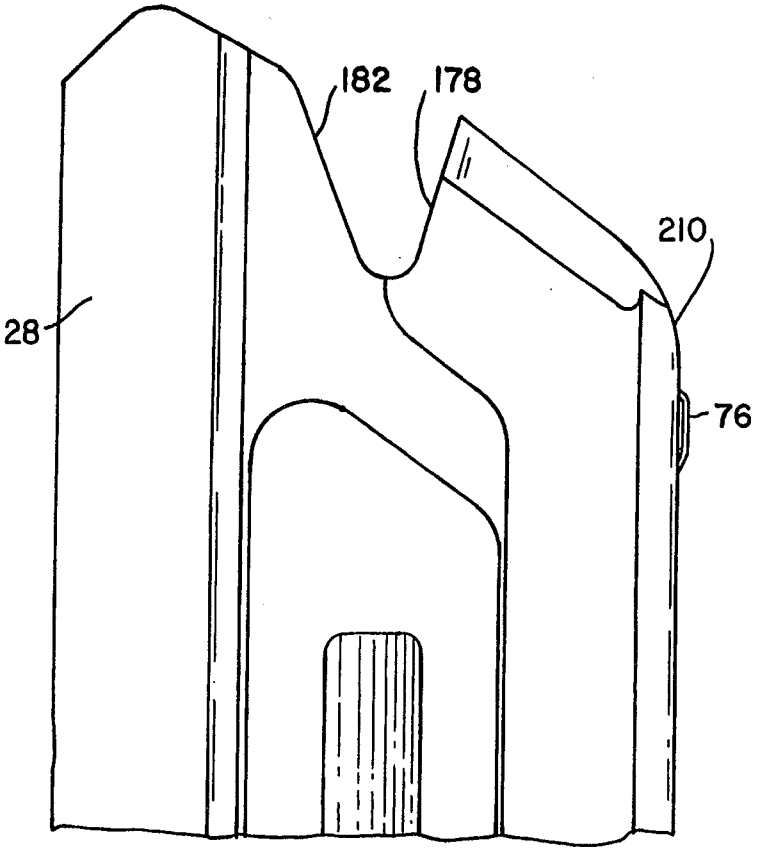
FIG. 11 is an enlarged fragmentary side view illustrating a curved entry edge on the upper part of the second end wall.

Referring particularly to FIGS. 11 and 12, the second end wall 40, at the upper part thereof and above the bridge piece 198, has a pair of curved entry edges 210, 214. When the magazine 20 is inserted into the firearm well, the first and second edges 210, 214 are the initial portions of the magazine that come into contact with an inner wall of the firearm well. In one make of firearm, a magazine release mechanism is located adjacent to the bottom of the firearm well. The curved entry edges 210, 214 act to provide a smooth transition relative to this inner wall of the firearm well as the magazine 20 is initially inserted therein. Accordingly, there is no unwanted bump or substantially discontinuous surface on the magazine end wall whereby an undesired "catch" or resistance is avoided during insertion of the magazine 20 into the firearm well.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiment described hereinabove is further intended to explain the best mode presently known of practicing the invention and to enable others skilled in the art to utilize the invention in such, or in other embodiments, and with the various modifications required by their particular application or uses of the invention. It is intended that the appended claims be construed to include alternative embodiments to the extent permitted by the prior art.

What is claimed is:

1. A magazine for housing .22 rimfire cartridges including truncated .22 rimfire cartridges and adapted to be connected to a firearm, comprising:

a magazine body for containing .22 rimfire cartridges, said magazine body having a first side wall and a second side wall, said first and second side walls being connected together using first and second end walls, said second end wall having an inner surface with a longitudinally extending center axis that bisects said second end wall inner surface into two equal halves, said magazine body having a height and said first and second side walls and first and second end walls defining a cartridge storage area along substantially all of said height of said magazine body, said storage area terminating in an outlet section located at a first end of said magazine body;

a follower movable in said cartridge storage area and having an upper surface on which truncated .22 rimfire cartridges are supported; and a spring connected to said follower for use in causing truncated .22 rimfire cartridges to move within said cartridge storage area;

wherein said storage area has a cross-section that is substantially the same throughout a majority of said storage area, said cross-section having a length and a width, said length and said width being predetermined to define an angle at which a first truncated .22 rimfire cartridge is positioned in such storage area, said angle having a value in a range between 29°–33° inclusive, said angle of the first truncated .22 rimfire cartridge remaining within said range of values throughout said majority of said storage area, wherein the first rimfire cartridge has a rim end and the rim end contacts at least two portions of said second end wall throughout said majority of said storage area, said two portions being separated from each other and with a non-contacting distance being defined between said two portions along which distance the rim end is free of contact with said second end wall, and with neither of said two portions being along said center axis of said second end wall.

2. A magazine, as claimed in claim 1, wherein:
said length of said cross-section is in the range of 0.856–0.864 inch.

3. A magazine, as claimed in claim 2, wherein:
said length of said cross-section is about 0.860 inch.

4. A magazine, as claimed in claim 1, wherein:
said width of said cross-section is in the range of 0.221–0.229 inch.

5. A magazine, as claimed in claim 4, wherein:
said width of said cross-section is about 0.225 inch.

6. A magazine, as claimed in claim 1, wherein:
said spring has a length that is extendable along an inner surface of said second end wall.

7. A magazine, as claimed in claim 1, wherein:
said second end wall includes first and second inward members connecting said second end wall with said first and second side walls, respectively, each of the truncated .22 rimfire cartridges contained in the magazine having a truncated nose end and a rim end, each truncated nose end contacting only one portion of said first end wall and each rim end contacting only said first and second inward members of said second end wall.

8. A magazine, as claimed in claim 7, wherein:
each of said first and second inward sections is curved.

9. A magazine, as claimed in claim 8, wherein:
each of said first and second inward members has a radius of about 0.031 inch.

10. A magazine, as claimed in claim 1, wherein:
each of said first and second sidewalls at said outlet section includes first and second jog portions, respectively, each of said first and second jog portions including an inward jog member and an outward jog member, each of said inward jog members contacting a truncated .22 rimfire cartridge during its movement from said outlet section into the .22 firearm.

11. A magazine, as claimed in claim 10, wherein:
a first distance is defined between said inward jog members and a second width is defined between said outward jog members, with said second width being greater than said first width.

12. A magazine, as claimed in claim 1, wherein:
said magazine body is made of metal and said first and second sidewalls include first and second slots, respectively, each of said first and second slots including a leg with said leg being at a an angle relative to a center axis through said height of said magazine body.

13. A magazine, as claimed in claim 1, wherein:
said first and second sidewalls include first and second lips, respectively, located at said outlet section, each of said first and second lips contacting said follower when said magazine body is empty of cartridges.

14. A magazine, as claimed in claim 1, wherein:

each of said first and second sidewalls includes a pair of ribs extending along substantially all of said height of said magazine body, said ribs on each of said first and second sidewalls engaging truncated .22 rimfire cartridges during their movement in said storage area.

15. A magazine, as claimed in claim 1, wherein:

said second end wall includes a bridge piece that is located inwardly relative to substantially all remaining portions of said second end wall.

16. A magazine, as claimed in claim 1, wherein:

said second end wall includes first and second curved entry edges disposed adjacent to said outlet section.

17. A magazine, as claimed in claim 1, wherein:

said second end wall includes a bridge piece and first and second curved entry edges adjacent to said outlet section, with said first and second curved entry edges being located upwardly from said bridge piece.

18. A magazine for housing .22 rimfire cartridges including truncated .22 rimfire cartridges and adapted to be connected to a firearm, comprising:

a magazine body for containing .22 rimfire cartridges, said magazine body having a first side wall and a second side wall, said first and second side walls being connected together using first and second end walls, said second end wall including first and second inward members connecting said second end wall with said first and second side walls, respectively, said magazine body having a height, and said first and second side walls and said first and second end walls defining a cartridge storage area along substantially all of said height of said magazine body, said storage area terminating in an outlet section located at a first end of said magazine body, with truncated .22 rimfire cartridges for exiting said outlet section into the firearm, each of the truncated .22 rimfire cartridges contained in the magazine having a truncated nose end and a rim end, each truncated nose end contacting only one portion of said first end wall and each rim end contacting said first and second inward members of said second end wall;

a follower in said cartridge storage area and having an upper surface on which truncated .22 rimfire cartridges are supported; and a spring connected to said follower for use in causing truncated .22 rimfire cartridges to move within said cartridge storage area, said spring includes portions that are positionable along said second end wall and a gap is formed between said spring portions and cartridges housed in said magazine using said first and second inward members;

wherein said storage area has a cross-section that is substantially the same throughout a majority of said storage area, said cross-section having a length and a width, said length and said width being predetermined to define an angle at which a truncated .22 rimfire cartridge is positioned in such storage area, said angle having a value wherein truncated .22 rimfire cartridges are received by the .22 firearm from said outlet section essentially without causing jamming.

* * * * *